US008197948B2

(12) United States Patent
Schneider

(10) Patent No.: US 8,197,948 B2
(45) Date of Patent: Jun. 12, 2012

(54) FURAN POLYMER IMPREGNATED WOOD, METHOD FOR PREPARING THE POLYMER AND USES THEREOF

(75) Inventor: Marc H. Schneider, Fredericton (CA)

(73) Assignee: Kebony AB, Oslo (NO)

( * ) Notice: Subject to any disclaimer, the term of this patent is extended or adjusted under 35 U.S.C. 154(b) by 0 days.

(21) Appl. No.: 12/659,274

(22) Filed: Mar. 2, 2010

(65) Prior Publication Data

US 2011/0027570 A1 Feb. 3, 2011

Related U.S. Application Data

(63) Continuation of application No. 10/398,123, filed as application No. PCT/NO01/00413 on Oct. 11, 2001, now abandoned.

(30) Foreign Application Priority Data

Oct. 12, 2000 (NO) ..... 20005137

(51) Int. Cl.
*B27K 3/15* (2006.01)

(52) U.S. Cl. ..... 428/537.1; 428/308.8; 427/303; 524/13

(58) Field of Classification Search ..... 428/537.1, 428/308.8; 427/303
See application file for complete search history.

(56) References Cited

U.S. PATENT DOCUMENTS

| | | | | |
|---|---|---|---|---|
| 2,909,450 | A * | 10/1959 | Goldstein | 427/244 |
| 3,622,380 | A | 11/1971 | Williams | |
| 3,697,575 | A | 10/1972 | Naarmann et al. | |
| 3,943,084 | A | 3/1976 | Hess | |
| 4,015,995 | A | 4/1977 | Hess | |
| 4,678,715 | A | 7/1987 | Giebeler et al. | |
| 4,735,974 | A | 4/1988 | Mandorf | |
| 5,002,981 | A | 3/1991 | Chiu | |
| 5,804,591 | A | 9/1998 | Valcke | |
| 6,124,028 | A | 9/2000 | Nagle et al. | |
| 6,451,153 | B1 | 9/2002 | Symons | |
| 6,670,029 | B2 | 12/2003 | Norton et al. | |
| 6,673,395 | B2 * | 1/2004 | Schneider | 427/297 |
| 7,008,984 | B2 * | 3/2006 | Schneider | 524/13 |
| 7,056,557 | B2 * | 6/2006 | Schneider | 427/303 |
| 2003/0148965 | A1 | 8/2003 | Hofer et al. | |
| 2006/0292366 | A1 | 12/2006 | Schneider | |

FOREIGN PATENT DOCUMENTS

| | | |
|---|---|---|
| EP | 1 069 173 A1 | 1/2001 |
| JP | 4-327336 | 11/1992 |
| JP | 7-256610 | 10/1995 |
| WO | WO 02/30638 A2 | 4/2002 |
| WO | WO 02/060660 A1 | 8/2002 |

OTHER PUBLICATIONS

John L. Philippou et al., "Bonding of particleboard using hydrogen peroxide, lignosulfonates, and furfuryl alcohol: effects of chemical composition of bonding materials," *Forest Products Journal*, vol. 32, No. 5, pp. 55-61, May 1982.

* cited by examiner

*Primary Examiner* — Leszek Kiliman
(74) *Attorney, Agent, or Firm* — Finnegan, Henderson, Farabow, Garrett & Dunner, L.L.P.

(57) ABSTRACT

A furan polymer impregnated wood which is uniform in color and density throughout the treated zone. In order to obtain the polymer impregnated wood, a parent wood has been impregnated with a mixture containing polymerizable organic compounds of at least furfuryl alcohol and one further compound. The invention also relates to a method for preparing a furan polymer impregnated wood and uses thereof.

7 Claims, No Drawings

FURAN POLYMER IMPREGNATED WOOD, METHOD FOR PREPARING THE POLYMER AND USES THEREOF

This application is a continuation of U.S. application Ser. No. 10/398,123 filed Sep. 4, 2003, now abandoned, which is a §371 of International Application No. PCT/NO01/00413 filed Oct. 11, 2001, which claims priority of Norwegian application No. 2000 5137 filed Oct. 12, 2000, the contents of all of which are incorporated herein by reference.

The invention described herein relates to a furan polymer impregnated wood which is uniform in colour and density throughout the treated zone. In order to obtain the polymer impregnated wood, a parent wood has been impregnated with a mixture containing polymerizable organic compounds of at least furfuryl alcohol and one further compound. The invention also relates to a method for preparing a furan polymer impregnated wood and uses thereof.

BACKGROUND OF THE INVENTION

Previous art for making a furan polymer impregnated wood by impregnating wood with a furfuryl alcohol solution and then polymerizing the furfuryl alcohol inside the wood, producing a dark brown wood polymer composite in treated zones, have been performed in different ways, as disclosed hereinafter.

1. Initiators

In the oldest method, initiators were water-soluble salts, particularly zinc chloride. The salt was dissolved in water and then the solution was added to the furfuryl alcohol. Salt weight was approximately 5% of furfuryl alcohol weight. This mixture was then impregnated into wood and polymerized using heat. As impregnation took place, the water and salt was retained by the wood near the surface. Furfuryl alcohol reaching deeper into the wood was therefore depleted of initiator and did not cure well. Therefore, this method was restricted to short or thin pieces of wood.

A newer method used a two-stage process. First, a zinc chloride solution in water was made. This was impregnated into wood and the wood dried. The amount of dried salt was approximately 5% of the calculated amount of furfuryl alcohol which would be impregnated in the following step. Next the wood was impregnated with furfuryl alcohol. It was then cured using heat. A uniform material was formed by this method, but it required 2 impregnation and drying stages.

2. Size of Material

For the older method, thin sections and short lengths of wood were required for the reasons mentioned above. Lumber-sized material had strong colour and density gradients when so treated, with the darker and denser material near the surfaces of the treated wood. In the well-treated zones near surfaces (or in small pieces), treated densities were in the range of 0.9 g/cc to 1.15 g/cc, while in the interior, the density approached that of the parent wood, and uncured furfuryl alcohol was usually present.

The newer method was not size-restricted like the older one, but the method took a great deal longer since drying in the first stage required care to prevent splitting and warping.

3. Colour of Material

Because of the gradients using the older method mentioned above, colour of the material varied with depth from surfaces. Machining or sanding therefore exposed material of lighter colour, with the colour varying with distance from the surface. The newer method had excellent colour throughout.

SUMMARY OF THE INVENTION

One of the main objects of the invention is to provide a furan polymer impregnated wood by using at least two chemicals in order to obtain an uniform impregnating solution Another object of the invention is to provide a uniform distribution of the chemicals in the furan polymer impregnated wood which is uniform in colour and density throughout the treated zone, giving an even, dark colour. This is obtained by one impregnation step.

Still another object of the invention is to provide a furan polymer impregnated wood having improved properties as regards dimensional stability, rot resistance, i.a.

According to the present invention, the foregoing and other objects are attained by a product, method and uses thereof as disclosed in the patent claims.

DETAILED DESCRIPTION OF PREFERRED EMBODIMENTS

In one embodiment of this invention, there is provided a furan polymer impregnated wood, characterized by wood impregnated with polymerizable furfural alcohol monomer solution containing at least furfuryl alcohol and one further compound selected from maleic anhydride, phtalic anhydride, maleic acid, malic acid, phtalic acid, and combinations thereof.

In another embodiment of this invention, there is provided a method for preparing a furan polymer impregnated wood, characterized in that the wood is impregnated by one impregnation step with polymerizable furfural alcohol monomer solution containing at least furfuryl alcohol and one further compound selected from the group consisting of anhydrides, acids and combinations thereof, followed by a curing step.

The keys to the invention are the use of one or more chemicals acting as new initiators. These initiators have similar affinity for wood as furfuryl alcohol and therefore enter the wood and remain in solution as deeply as it penetrates. Wherever the solution penetrates, it is polymerizable. The initiators are selected from any anhydride-containing compound as well as acids selected from the group of maleic acid, malic acid, phthalic acid, and stearic acid. However, preferably a compound selected from maleic anhydride, phthalic anhydride and combinations thereof is used. More preferably, maleic anhydride or phthalic anhydride or a combination thereof is used, most preferably maleic anhydride or phthalic anhydride. To make a treating solution, at least one of these initiators, preferably one of these initiators only, is dissolved directly in furfuryl alcohol, forming a solution which has several months useful life at room temperature. The concentration ranges from about 5% to about 20% based on the weight of furfuryl alcohol. The lower concentrations have longer storage life and cure more slowly when heated. The higher concentrations are used when quicker cures are needed, when lower-than-normal cure temperatures are required or when using woods which contain inhibitors to polymerization.

Impregnation of the wood by the initiated treating solution is carried out using a full-cell process, which uses an initial vacuum followed by super-atmospheric pressure which ranges from about 1 to about 20 atmospheres. Initial vacuum can be in the range of from about 5 min to about 30 min. or more, and super-atmospheric pressure can be in the range of from about 20 min. to about 1 h or more.

Curing is carried out using heat delivered by hot air, steam, hot oil, or high frequency heating. The heat activates the initiators and starts polymerization. Usual curing temperature can be in the range of from about 70 to about 140° C. Curing requires either some time at about 90° C. followed by some time at about 140° C., or just some time at about 140° C. Times will vary with the size of material and type of oven. The time of curing can be in the range of from about ½ h to about 12 h, in particular from about ½ h to about 6 h. The time is not critical nor is the lower temperature. But the higher temperature step is novel and is critical in order to obtain a product of good quality. When using hot air, the curing temperature is about 90° C. The material is placed in the heated environment. When it reaches about 90° C., an exothermic polymerization reaction begins. The further heat generated by the reaction accelerates curing, which is completed in a few minutes. Then the temperature is raised to about 140° C. for about one hour to drive off reaction products and uncured monomer(s). The high-temperature finishing stage after curing is a key part of the invention. Alternatively, a temperature giving burns to the woody material can be used as the maximum temperature (the burn temperature). When an atmosphere of air is used, oxygen will more easily give burns. In order to avoid this problem, an atmosphere free of oxygen should be used.

The starting material is a woody material, usually lumber, which includes plank (thick lumber), but can also be wood composites such as oriented strand board and particle board. Woody materials of any dimensions can be utilized, preferably large dimensions, wherein the maximum dimension of the length of the finished material is 100 m, the maximum dimension of the diameter of the finished material is 7 m, an the maximum dimension of the cross section of said finished material is 40 $m^2$. Usually, lumber (plank) is a maximum of 50 mm thick. However, the length is more important since the treating solution travels very fast along the length but very slow across the cross-section. With permeable woods like beech and birch, the uniformity of treatment is determined by how well the treating solution remains uniform as it travels along the length. When impregnation is complete, the woody material formed by this method has uniform properties throughout. Colour, resistance to moisture and deterioration and mechanical properties are consistent throughout. The properties and colour of individual pieces of lumber treated this way depend upon the loading of polymer achieved. Different species of wood, and even different boards of the same species, may impregnate differently. Those boards which accept more polymer have a darker colour and greater hardness. However, resistance to moisture and deterioration are little affected by loading.

Moisture content of the woody material can be in the range of up to about 30%, in particular more than about 15%, but can also be lower than 15%. However, the moisture content of the woody material is not critical.

Woody material, including cheap types and scrap material, can be used to produce noble wood products such as imitation teak, mahogany, rattan and others, and also provide them with novel properties like water resistance and simpler and reduced maintenance requirements.

While specific compositions, methods and uses are referred to herein, it is to be understood that such specific recitals are not to be considered limiting but are included by way of illustration and to set forth the best mode in accordance with the present invention.

EXAMPLE

Boards of three hardwood species approximately 1 m long and 12 mm thick were bundled together and vacuum-pressure impregnated using a treating solution containing 5% maleic anhydride and 95% furfuryl alcohol. Curing was done in a hot-air oven at 95° C. for 2 h followed by 3 h at 140° C. At each stage of treating, each bundle was weighed. At the end, the conversion of monomer to polymer was calculated, knowing the reaction products lost. Some boards were cut apart after treating and their uniformity of treatment evaluated using colour change.

The treating data is given in the table below, wherein wood type 1 is beech, wood type 2 is maple and wood type 3 is birch.

| | a 6% MC untreated kg | b Calc. OD kg | c 6% MC treated kg | d OD cured kg | e Monom. % | f Polym. % | g Polym. conv. % | h Density g/cc |
|---|---|---|---|---|---|---|---|---|
| 1 | 30.00 | 28.30 | 54.24 | 48.94 | 92 | 73 | 98 | 1.12 |
| 2 | 30.90 | 29.15 | 56.30 | 49.10 | 93 | 68 | 90 | 1.04 |
| 3 | 25.36 | 23.92 | 50.78 | 43.22 | 112 | 81 | 88 | 0.99 |

wherein
a Is weight as received at 6% moisture content (MC)
b Is the calculated ovendry (0% MC) weight
c Is the recorded weight after impregnation (which still includes the moisture)
d Weight after curing, with moisture also gone because of heating
e Percent monomer in wood (from c) based on calculated OD weight
f Percent polymer in wood (from d) based on calculated OD weight
g The percent of the monomer which was converted into polymer during curing
h Is the final, cured density Maple and birch behaved similarly to one another. They impregnated quite well, but surfaces treated slightly better than interiors which were lighter brown. They had slightly lower uptake, densities and conversion efficiencies than beech. Beech had the highest uptake and conversion and density, and was uniformly treated throughout. It was the best species used. It had uniform, dark colour throughout when cut.

The new impregnation formula and curing schedule produced uniform wood polymer composite using beech, and quite uniform material using maple and birch.

It will be apparent to those skilled in the art that various modifications and variations can be made in the compositions, methods and uses of the present invention without departing from the spirit of scope of the invention. Thus, it is intended that the present invention cover modifications and variations of this invention provided they come within the scope of the appended claims and their equivalents.

The invention claimed is:

1. A furan polymer impregnated woody material comprising a woody material impregnated with a furan polymer of a cured polymerizable furfuryl alcohol monomer solution consisting essentially of furfuryl alcohol and one further compound dissolved directly in said furfuryl alcohol, wherein said one further compound is selected from the group consisting of maleic anhydride and maleic acid, and combinations thereof.

2. The furan polymer impregnated woody material of claim 1, wherein the woody material is lumber.

3. The furan polymer impregnated woody material of claim 1, wherein the woody material is a wood composite.

4. The furan polymer impregnated woody material of claim 1, wherein the concentration of said one further compound in said solution is from about 5% to about 20% based on the weight of furfuryl alcohol.

5. A method for preparing a furan polymer impregnated woody material comprising impregnating woody material in one impregnation step with a polymerizable furfuryl alcohol monomer solution consisting essentially of furfuryl alcohol and one further compound dissolved directly in said furfuryl alcohol, wherein said one further compound is selected from the group consisting of maleic anhydride and maleic acid, and combinations thereof, followed by a curing step.

6. The method of claim 5, wherein said curing is performed at a temperature in the range of from about 70 to 140° C.

7. The method of claim 6, wherein said curing requires either between 10 min, to 2 h at about 90° C. followed by 15 min, to 4 h at about 140° C., or just between 15 min, to 4 h at about 140° C.

* * * * *

UNITED STATES PATENT AND TRADEMARK OFFICE

CERTIFICATE OF CORRECTION

PATENT NO. : 8,197,948 B2
APPLICATION NO. : 12/659274
DATED : June 12, 2012
INVENTOR(S) : Marc H. Schneider It is certified that error appears in the above-identified patent and that said Letters Patent is hereby corrected as shown below:

On the Title Page, Item (73), after "ASSIGNEE", "Kebony AB" should read --Kebony ASA--.

Signed and Sealed this
Twenty-second Day of January, 2013

David J. Kappos

David J. Kappos
*Director of the United States Patent and Trademark Office*